United States Patent [19]

Schurgin

[11] Patent Number: 4,880,020

[45] Date of Patent: Nov. 14, 1989

[54] TRAVELING TOOTHBRUSH HOLDER

[76] Inventor: Jeffrey S. Schurgin, 57 Sears Rd., Wayland, Mass. 01778

[21] Appl. No.: 142,546

[22] Filed: Mar. 21, 1988

[51] Int. Cl.[4] ..... A45D 44/18

[52] U.S. Cl. ..... 132/308; 206/362.3

[58] Field of Search ..... 132/308; 206/209.1, 206/210, 362.2, 362.3, 15.2, 15.3, 209, 361, 63.5, 368, 369; 220/254, 255; 15/257.05, 257 R

[56] References Cited

U.S. PATENT DOCUMENTS

| | | | |
|---|---|---|---|
| 1,041,315 | 10/1912 | Marx | 132/308 |
| 2,655,968 | 10/1953 | Simmons | 206/362.3 |
| 3,120,019 | 2/1964 | Scott | 132/308 |
| 3,291,295 | 12/1966 | Caligiuri | 206/15.3 |
| 3,977,559 | 8/1976 | Lombardi | 220/254 |
| 4,165,804 | 8/1979 | Georgopoulos | 220/254 |
| 4,462,507 | 7/1984 | Margulies | 206/210 |
| 4,535,908 | 8/1985 | Dabich | 220/254 |

*Primary Examiner*—John J. Wilson
*Assistant Examiner*—Adriene J. Lepiane
*Attorney, Agent, or Firm*—Weingarten, Schurgin, Gagnebin & Hayes

[57] ABSTRACT

A toothbrush holder adapted for ease of packing and unpacking during travel, in which the travel receptacle functions as a drinking cup and which includes a lid having elements for retention of the toothbrush within the cup during travel.

6 Claims, 2 Drawing Sheets

TRAVELING TOOTHBRUSH HOLDER

FIELD OF INVENTION

This invention relates to toothbrush holders and more particularly to a holder adapted for travel use.

BACKGROUND OF THE INVENTION

Travel holders for toothbrushes are known and usually comprise an elongated case in which the toothbrush can be disposed. Another form of travel case is in the form of a small pouch for retaining a toothbrush of a type in which a portion of the handle can be removed.

These holders of known construction serve only to contain the toothbrush during travel. Other items for dental hygiene such as a cup, toothpaste, mouthwash, must still be carried separately during travel.

SUMMARY OF THE INVENTION

The present invention provides a traveling toothbrush holder in which the travel receptacle functions as a drinking cup as well as a container for the brush. The cup includes a lid which may be integrally formed with the cup, and which includes means for retaining the brush during storage, and having a hinged portion disposable in a raised position for drinking use, and in a closed position for retention of a brush within the cup. The container is preferably fabricated of a suitable plastic material, providing relatively inexpensive fabrication and a finished product which can be easily cleaned.

DESCRIPTION OF THE DRAWINGS

The invention will be more fully understood from the following detailed description read in conjunction with the accompanying drawings in which.

DETAILED DESCRIPTION OF THE INVENTION

Figure 1:
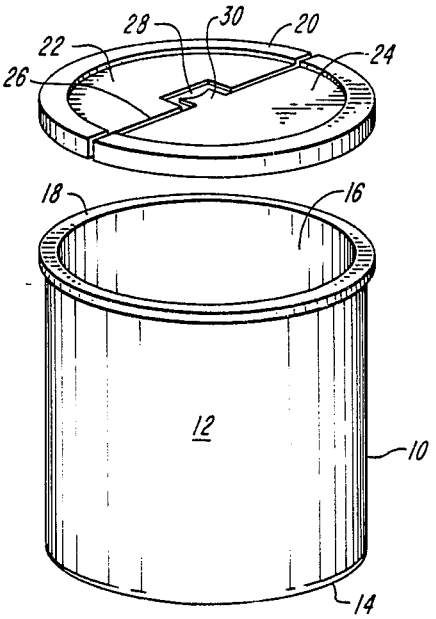
FIG. 1 is a pictorial view of an embodiment of the invention.
Figure 2:
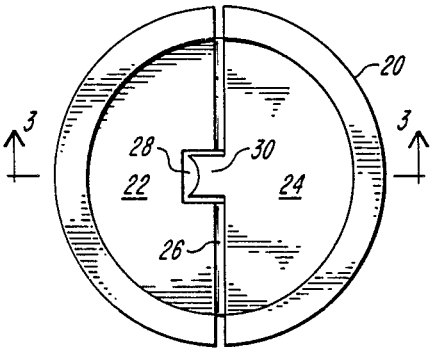
FIG. 2 is a top view of the lid of FIG. 1 in closed position.
Figure 3:
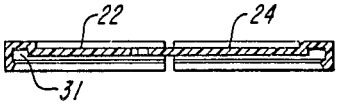
FIG. 3 is a sectional view of the lid of FIG. 2 in closed position.
Figure 4:
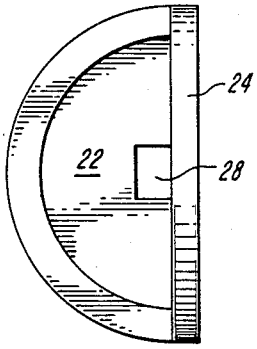
FIG. 4 is a top view of the lid of FIG. 1 in open position.
Figure 5:
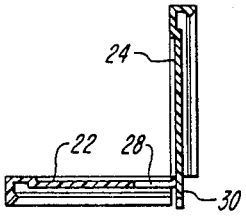
FIG. 5 is a sectional view of the lid of FIG. 2 in open position.

Referring to the drawings there is shown the traveling toothbrush holder in accordance with the invention and which comprises a cup shaped receptacle 10 having a cylindrical wall 12, a bottom 14, an open mouth 16 and surrounding rim 18. A lid 20 is disposable on the rim 18, the lid having a first portion 22 affixed to the rim, and a second portion 24 pivotable about a hinge line 26 to a raised position, as seen in FIGS. 4 and 5, and a closed position as seen in FIGS. 2 and 3. The lid includes an opening 28 centrally disposed therein, the opening being of a size to accommodate the handle of the toothbrush. The opening includes one or more elements 30 for retaining the toothbrush handle when in its closed position. In the embodiment of FIG. 1, the element 30 is composed of a tab which lies coplanar within the opening 28, when the lid is closed (FIG. 2), and lies transversely to the opening when the lid is open (FIG. 5). The tab is sized and configured to engage or closely confront the handle of the toothbrush inserted into the lid opening.

In the above embodiment, the lid and cup are separately fabricated, with the lid 20 being attachable to the cup rim 18 by a press - fit groove 31 cooperative with the rim 18, as shown in FIG. 1. The hinge is preferably an integrally formed self hinge in the plastic material, usually provided as a seam of reduced thickness.

Figure 6:
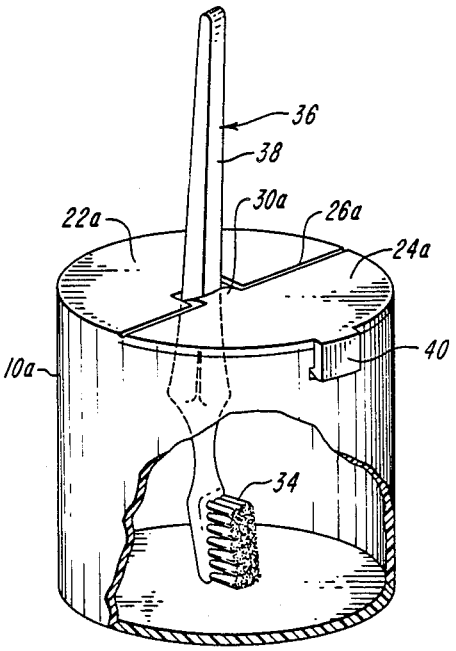
FIG. 6 is a pictorial view of an alternative embodiment having an integrally formed lid.
Figure 7:
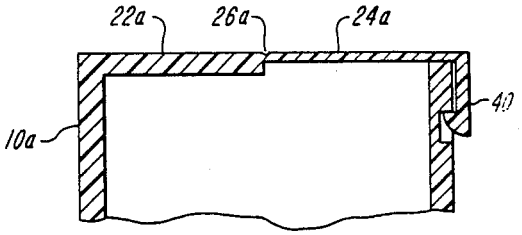
FIG. 7 is a sectional cutaway view of the embodiment of Fig. 6.

Alternatively, the cup, lid and retaining element can be integrally molded as a single unit of a plastic material providing the requisite cleanliness, as in FIGS. 6 and 7. Here, the cup 10*a* has an integrally formed cover portion 22a, and a hinged cover portion 24*a*, pivotable about a hinge 26a. The cover is retained in a closed position by a latch 40. The cover has a tab 30*a* for retaining the toothbrush handle.

The cup receptacle can take a variety of shapes to suit size and aesthetic requirements. In addition to the cylindrical version illustrated, the cup can be of conical configuration, outwardly tapering toward the rim, as in a conventional coffee cup, or of other convenient shape.

The toothbrush is installed in the receptacle in the following manner. With the lid raised to its approximate right angle position as shown in FIG. 4, the bristle end 34 of a toothbrush 36 is inserted through the opening 28, and the lid then closed onto the rim. The toothbrush can be pushed into the cup until the bristle end engages the cup bottom. The handle 38 is retained by the tab 30 such that the toothbrush remains secured within the receptacle for easy packing and stowage as a unit for travel. If desired, the cup can be made of sufficient size to contain a small tube of toothpaste and small container of mouthwash.

The toothbrush is removed from the receptacle for use by opening the lid 20 to its approximate right angle position, and by pulling the toothbrush by its handle 30 out of the lid retainer. With the lid in its raised position, the cup receptacle is accessable for drinking and rinsing use. To enhance the drinking use of the cup, the lid can be hinged to fold 180° to a fully open position.

The invention is not to be limited by what has been particularly shown and described, except as indicated in the appended claims.

I claim:

1. A traveling toothbrush holder comprising:

a cup shaped receptacle having a side wall, a bottom, a top which is at least partially open, and a peripheral rim around the open top;

a lid on the top, having a first portion affixed to the peripheral rim of the receptacle, and a second portion hinged to the first portion and pivotable to a raised open position and to a closed position in engagement with the rim;

the lid having retaining means which includes:

an opening through a central portion of the lid on one portion of the lid, and a tab on the other portion of the lid;

the second portion of the lid in its raised position having one of the opening or tab disposed transversely to the plane of the first portion of the lid to provide access for insertion of a toothbrush through the opening;

the second portion of the lid in its closed position having the other of the opening or tab generally coplanar with the plane of the lid to engage and retain the toothbrush disposed through the lid opening.

2. The toothbrush holder of claim 1 wherein the lid is integrally formed of plastic material and having a hinge along a diameter of the lid.

3. The toothbrush holder of claim 2 where the receptacle and lid are integrally formed as a single unit.

4. The toothbrush holder of claim 1 wherein the opening in the lid is in the first portion of the lid, and the tab is on the second portion of the lid.

5. A traveling toothbrush holder comprising:

a cup shaped receptacle having a side wall, a bottom, a top which is at least partially open, and a peripheral rim around the open top;

a lid on the top, having a first portion affixed to the peripheral rim of the receptacle, and a second portion hinged to the first portion and pivotable to a raised open position and to a closed position in engagement with the rim;

the lid having retaining means which includes:

an opening through the first portion of the lid and having an edge at the hinge of the lid, and a tab on the second portion of the lid;

the second portion of the lid in its raised position having the tab disposed transversely to the plane of the first portion of the lid to provide access for insertion of a toothbrush through the opening;

the second portion of the lid in its closed position having the tab generally coplanar with the plane of the lid and spaced and configured to engage and retain the toothbrush disposed through the lid opening.

6. The toothbrush holder of claim 5 wherein the tab includes a curved distal end operative to engage the handle of a toothbrush inserted through the lid opening.

* * * * *